United States Patent [19]

King

[11] 4,134,586

[45] Jan. 16, 1979

[54] PORTABLE RUNNING ROPES WITH FLAT SPRING CROSS MEMBERS

[76] Inventor: James R. King, 6804 Capstan Dr., Annandale, Va. 22003

[21] Appl. No.: 814,905

[22] Filed: Jul. 12, 1977

[51] Int. Cl.[2] ..... A63B 67/00

[52] U.S. Cl. ..... 273/55 R

[58] Field of Search ..... 273/55 R, 55 A, 55 B, 273/194, 95 H, 29 BB, 31; 248/188.1, 188.7; 272/70, 100, 65, 101, 102, 103, 85, 86; 297/272, 274; 5/11, 10, 12, 94, 14, 17

[56] References Cited

U.S. PATENT DOCUMENTS

| | | | |
|---|---|---|---|
| 2,354,050 | 7/1944 | Paupa | 273/55 R |
| 2,685,140 | 8/1954 | Nedwick | 273/55 R |
| 2,944,816 | 7/1960 | Dixon | 273/26 A |
| 3,195,898 | 7/1965 | Respini | 273/26 A |
| 3,255,115 | 6/1966 | Peterson | 272/70 |
| 3,433,480 | 3/1969 | Coleman et al. | 273/55 R |
| 3,804,410 | 3/1974 | Gilman | 273/55 R |
| 4,059,268 | 11/1977 | Forrest | 273/55 R |

FOREIGN PATENT DOCUMENTS

| | | | |
|---|---|---|---|
| 848322 | 10/1939 | France | 5/114 |
| 469710 | 3/1952 | Italy | 5/110 |
| 252102 | 12/1947 | Switzerland | 5/114 |
| 394023 | 6/1933 | United Kingdom | 5/112 |

*Primary Examiner*—Richard C. Pinkham
*Assistant Examiner*—T. Brown
*Attorney, Agent, or Firm*—Lowe, King, Price & Becker

[57] ABSTRACT

A portable practice runway is provided with an improvement comprising cross members made of flat spring steel with the central section of the cross member thereby lying flat on the surface allowing the runner's foot to substantially fully engage the ground when the cross member is inadvertently stepped on. The cross member is preferably of one piece with the upstanding side members being formed by bends in the cross member. The upstanding legs have sufficient resiliency to flex when the cross lines are inadvertently stepped on by the runner thereby allowing the runner's foot to more fully engage the ground to prevent injury. In the relaxed position, the cross members are provided with a pre-bow so that when the lines are attached, the center section will be drawn flat with the running surface and the upstanding legs will be positioned substantially vertical. In one embodiment, an integral loop at the top of the vertical legs supports the side members and forms the joint between adjacent sections.

10 Claims, 5 Drawing Figures

PORTABLE RUNNING ROPES WITH FLAT SPRING CROSS MEMBERS

FIELD OF THE INVENTION

The present invention relates to athletic training devices, and more particularly to a portable running device for allowing a runner to practice to improve his timing and agility.

The training in running sports, such as track and football, has been greatly helped over the past few years from the development of portable running ropes. The preferred embodiment of the first successful running ropes were provided with means to render cross lines stretchably resilient and having sufficient resiliency to allow the runner's foot to go to the ground when stepped on. This concept is shown and claimed in the original U.S. Pat. No. to Coleman et al 3,433,480, entitled "Portable Running Ropes", issued Mar. 18, 1969, assigned to the same assignee as the exclusive licensee of the present invention. This original device has met with considerable commercial success so that it is now the standard for training of football players and other athletes for improving running timing and agility.

As shown in the original Coleman 3,433,480 patent, the earliest design had cross members extending across the runway at every three spaces. The runner proceeding along the runway could step on any of the resilient cross lines and his foot would harmlessly go to the ground. However, if he happened to step on the particular cross line directly above the tubular cross member of the framework, his foot would come down not only on the rope, but also on the tubular member. This occurred with substantial frequency, since the cross members were placed so closely together along the runway. Thus, while the problem of injury associated with stepping on the cross lines had been solved, the potential of stepping on the tubular cross members still existed and was annoying to the players. The discomfort to the foot of the runner, particularly the arch of the foot, as the player would come down hard on the tubular central section of the cross member, previously had led others to attempt to solve this problem.

Alleviation of this particular problem and other concepts for improvement are covered in a later filed application entitled "Portable Runway With Longitudinal Supports And Tension Holding Means", by James T. Coleman, Ser. No. 704,523, filed July 12, 1976. As set forth in that application, the provision of longitudinal support members allowed the cross members to be spaced substantially further apart thereby reducing the incidence of stepping on the cross member. This change, along with the concepts for easy assembly of the device and simplification of the framework, have been well accepted and successful. However, there still existed the possibility of the runner stepping on a cross member having a tubular cross section that would not allow the runner's foot to be substantially fully and completely planted on the ground and this need resulted in the present invention.

OBJECTIVES OF THE INVENTION

Therefore, it is one object of the present invention to provide a portable runway with cross members that are flat to allow the runner's foot to effectively go to the ground if the cross member is stepped on.

It is another object of the present invention to provide the cross members of a runway fabricated of flat spring steel in order to give improved resiliency to the cross lines and to allow the runner's foot to be planted firmly on the ground if the cross member is stepped on.

It is another object of the present invention to provide a running training device with simplified and safer supporting cross members made of flat steel that may be prebowed in order to lay flat along the running surface when a rope grid is attached to the frame and may have integral loops at the ends to receive the side members.

Still other objects and advantages of the present invention will become readily apparent to those skilled in this art from the following detailed description, wherein I have shown and described only the preferred embodiment of the invention, simply by way of illustration of the best mode contemplated by me of carrying out my invention. As will be realized, the invention is capable of other and different embodiments, and its several details are capable of modification in various obvious respects, all without departing from the invention. Accordingly, the drawings and description are to be regarded as illustrative in nature, and not as restrictive.

DETAILED DESCRIPTION OF THE INVENTION

Figures 1, 2, 3, 4, 5:
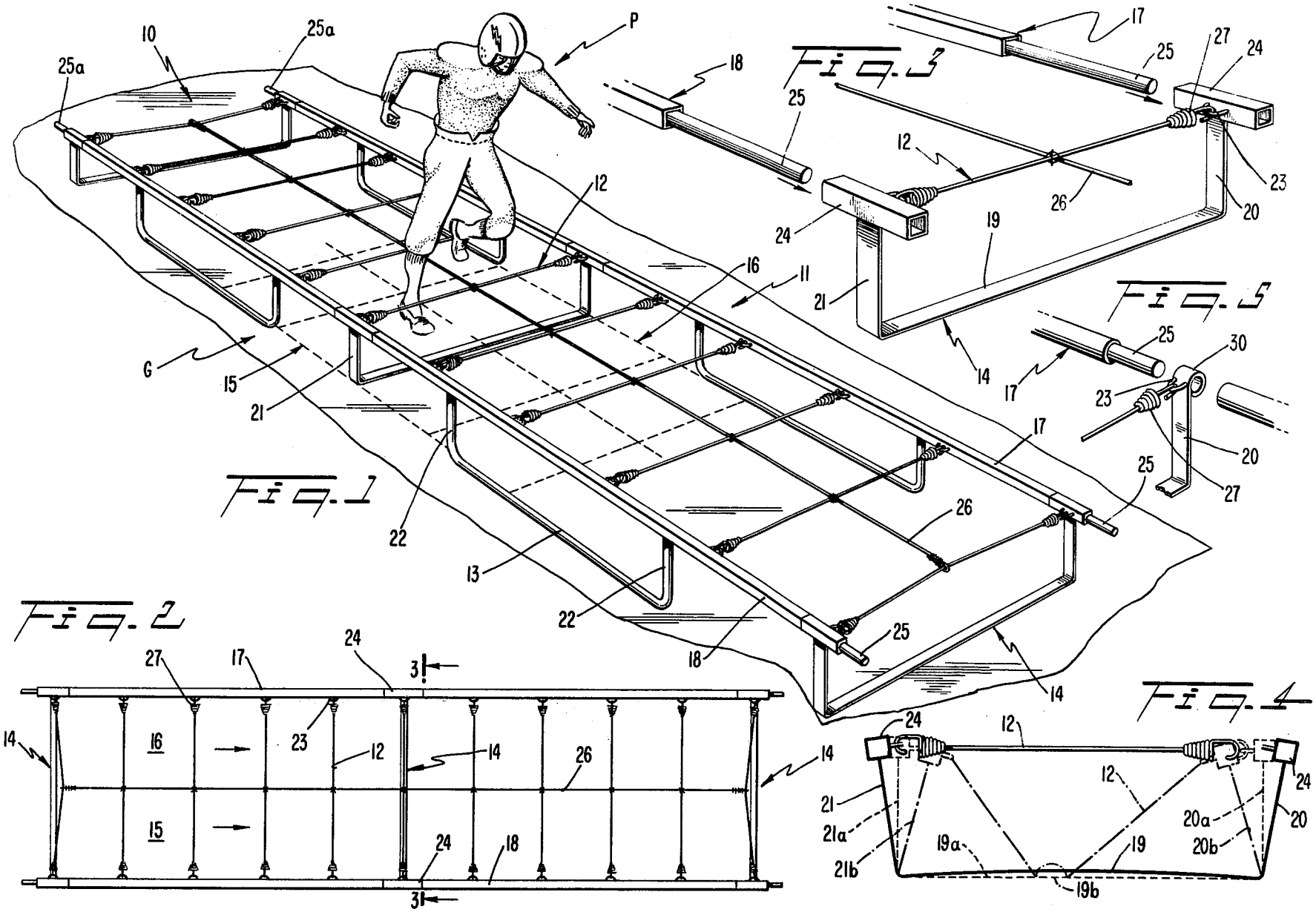
FIG. 1 is an overall perspective view of the runway according to the present invention.
FIG. 2 is a top view of the runway.
FIG. 3 is a detailed perspective view showing parts of the runway at the joint between two sections.
FIG. 4 is a cross-sectional view showing the various positions of the flat cross member and the springing action.
FIG. 5 is a detailed perspective view showing an alternative embodiment of the parts making up the joint between the two sections.

With reference now to FIG. 1 of the drawings, there is shown a practice runway 10 comprising a framework, generally designated by the reference numeral 11, supporting a latticework or grid 12 forming a runway for a runner or player P. As shown, the runway is to be placed on a flat surface, such as the ground G and defines a running course for the player P. Running through the grid 12 improves the agility, coordination and balance and has proven to be a highly effective training device for running sports. The basic device, disclosed and claimed in the original Coleman et al patent, 3,433,480, identified above, is widely accepted in the athletic training field for effectiveness in training and its safety in use. The present invention is an improvement over this original invention and the subsequent Coleman invention of the 704,523 application, also identified above.

The basic supporting structure of the framework 11 comprises two longitudinal U-shaped support members 13 and one U-shaped cross member 14, per section, as shown in FIG. 1. The longitudinal support members 13 are positioned along the outer limit line of the spaces 15 along the ground G that are designated by the grid of ropes 12 in which the runner P is to place his feet. The support members 13, 14 support the main frame side members 17, 18 in the middle and at the ends, respectively, so as to position the grid 12 above the surface. With the grid 12 above the surface the runner P is forced to negotiate the course in a high-stepping manner which is the preferred mode of running for football players and other running sports.

The longitudinal support members 13 support the side rails 17, 18 in the manner taught and claimed in the prior improvement patent application 704,528 to Coleman. As previously noted, the present invention further improves on the effectiveness and safety of the training device that was obtained by this prior improvement invention.

In order to obtain the objectives of the invention, the cross member 14 is made of flat, spring steel strips as best shown in FIG. 3. The steel strip stock is preferably like that used for vehicle leaf springs and may be formed during manufacture of the device in a similar manner.

The central section 19 of the cross member 14 is positioned along the ground G with the upstanding legs 20, 21 formed at the ends of the cross member 14 by bends in the flat steel member.

The grid or latticework of ropes 12 includes cross lines that are attached to inwardly directed loops 23 on the horizontal sleeves 24 that form the joint between two sections of the runway. These loops 23 are also provided along the side members 17, 18 to receive the cross lines as best shown in FIG. 1. A center line 26 extends along the center of the runway and the cross lines are each provided with cone connectors 27 at their ends.

The lines are preferably elastic shock cord so as to give the runner P inadvertently steps on one. The lines are sufficiently stretchably resilient to allow the runner's foot to go to the ground when stepped on to avoid injury, as more fully described in the original Coleman et al patent 3,433,480.

The sleeves 24 are adapted to receive the connector rod section 25 of reduced size in a telescoping fashion. These rod sections 25 pass through the sleeves 24 and into the mating end of the side members 17, 18, as fully described and claimed in the previous Coleman application, Ser. No. 704,523. These sleeves 24 plus the side members 17, 18 may by choice be square in cross section, or round if desired.

The longitudinal side supports 13 include upstanding legs 22 that are welded to the bottom of the side members 17, 18 to provide support between the adjacent cross members 14.

The advantages of the flat cross members 14 can best be seen in FIG. 4. In this Figure the central section 19 is shown in the full line position where the cross lines 12 have not been attached to both of the connecting loops 23. The cross member 12 being made of spring steel is flexible toward the inside of the runway and the prebow in the central section 19 shown in the full line position compensates for flexure once the grid of ropes 12 have been attached to the loops 23.

When the grid 12 is attached by positioning the connectors 27 in the loops (see dashed line position of components 19*a*, 20*a* and 21*a*) the desired conformance to the flat surface G and the vertical positioning of the legs 20, 21 are attached by the tension in the cross lines. It will also be noticed in FIG. 1, that the attached position (dashed line of FIG. 4) establishes by the equality of tension forces sufficient stretching to keep the grid taut to define the spaces for the runner P. In the event that one of the cross lines is inadvertently stepped on by the runner P during practice, the runner's foot is allowed to continue down until it firmly plants itself along the ground G.

Of most importance, if the runner's foot comes down over the top of the flat central section 19*b* of the cross member 14, the same result is attained. The showing of the foot in FIG. 4 clearly illustrates how important the flat cross member 14 is to the concept of allowing firm planting of the foot even if the rope immediately above the cross member is the one accidentally stepped on. Previously the user of the device had to cope with the worry of stepping on one of the tubes forming the central section of the cross member. The thought of having the foot, and particularly the arch, land squarely on the round tubing that previously formed the cross members 14 impaired the reaching of full potential of the effectiveness and safety of the device. Now the runner P is fully confident that his foot will be firmly planted on the ground even if he misses one of the spaces and steps on the cross member 14 because it is flat.

As mentioned above, the cross lines of the grid 12 are preferably stretchably resilient in order to allow the runner's foot to go to the ground when stepped on. However, the U-shaped members 14 being made of flat spring steel enhances and improves the flexibility of the device by allowing restricted inward movement of the upstanding legs, as shown by the dot-dashed line denoting upstanding members 20*b*, 21*b*. It will be noticed in FIG. 4, that both the cross line has stretched and the upstanding legs have flexed in order to give the desired dual resiliency and thereby improved flexibility in the device.

Since the side members 17, 18 interconnect the adjacent cross members 14, the flexure at any point along the runway will involve to some degree two or more of the cross members 14. If the cross line is stepped on immediately above a cross member 14, then the flexure will be at a maximum at that cross member, as emphasized in FIG. 4. In between, the flexure is progressive and varies inversely to the distance from each of the cross members 14.

The entire structure, including the new flat cross member 14, is simple in design and rugged to give exceptional service in use. Only one cross member 14 is required for each section of the runway, with the exception that an initial cross member supported on connector sections 25*a* is provided at the start of the running course. The shock cord for the grid 12 is desirable because of its flexibility and its ability to hold its original taut condition and shape. This in combination with the flexible cross member 14 gives unexpected improved flexing efficiency and helps the runner keep his balance if the lines are stepped on during the running exercise. The flexible cross lines and cross member 14 also allow good upward flexure in the event that the toe of the runner P is caught under one of the cross lines.

In FIG. 5, an alternative construction of the framework 11 in the area of the joint between the sections is shown. The use of the flat cross member 14 advantageously adapts itself to the formation of an integral loop or eye 30 at the top of the legs 20, 21 through which the reduced rod section 25 passes for support. The outer diameter of the loop 30 matches the diameter of the adjacent side members 17, 18 to effectively provide continuous side members, as in the embodiment of FIG. 3. The loop 30 is economical to form since it can simply be rolled at the time the bends are placed in the cross member to form the legs 20, 21.

In view of the foregoing, it can be seen that the provision of cross members 14 fabricated of flat steel stock thus gives several important advantages. A runner is free to run full out along the course since he does not have to concentrate on missing the cross members 14 that he could inadvertently step on. This has provided new aggressiveness in the users of the device and therefore improves its effectiveness as a training piece of equipment, especially for football players. The runner's foot may be firmly planted on the ground along the course even with the central section 19 of the flat cross member 14 underneath without serious discomfort. There is virtually no chance of injury, such as a bruise to the arch of the foot, as the runner P negotiates the running course.

As the grid 12 of rope flexes, the spring-like cross members 14 may also flex giving improved safety and efficiency by allowing the runner a better chance of retaining his balance. The safety is further enhanced by the retention of the full length side members 17, 18 so that should the player fall toward the side of the device, these members will be engaged rather than sharp upstanding members, such as stakes that were previously used for staking out a grid of ropes.

In this disclosure, there is shown and described only the preferred embodiment of the invention, but, as aforementioned, it is to be understood that the invention is capable of use in various other combinations and environment and is capable of changes or modifications within the scope of the inventive concept as expressed herein.

What is claimed is:

1. A portable runway for use by a runner to practice running along a course on a generally flat surface comprising, an elongated framework including a plurality of opposed side members, cross members adapted to support said side members in a spaced relationship to each other and inspaced relationship to said flat surface, said cross support members being of generally U-shaped configuration and extending across said running course, means connected to said framework providing a grid at a predetermined height above said surface and at predetermined spaced intervals to define spaces along said course in which the runner is to place his feet during use, said cross support members including a substantially flat center section lying along said course and two upstanding side legs to support said side members, said center section being sufficiently flat and lying substantially flat on said surface to allow the runner's feet to substantially fully engage said surface along said course when said center section is stepped on.

2. The runway of claim 1 wherein said cross members include substantially flat upstanding legs to support said side members

3. The runway of claim 2 wherein said cross members comprise a single piece of material with the upstanding legs being formed by a bend at each end of said center section.

4. The combination of claim 3 wherein said U-shaped cross member is formed of flat spring metal.

5. The runway of claim 4 wherein the spring metal has sufficient resiliency to spring inwardly when said grid means is inadvertently stepped on by the runner; whereby the runner's foot may easily engage said surface along said course.

6. The runway of claim 2 wherein the upper ends of said legs are formed in an integral loop, a rod section passing through said loop and connecting the adjacent ends of said side members to form the joint between adjacent sections of said runway.

7. The runway of claim 1 wherein is further provided resilient means on said grid means and said cross member having sufficient resiliency to permit the runner's foot to engage said surface along said course when stepped on.

8. A portable runway for use by a runner to practice running along a course on a generally flat surface comprising, an elongated framework including a plurality of opposed side members, U-shaped cross members adapted to support said side members in spaced relationship to each other and in spaced relationship to said flat surface, said cross members being flat with a center section lying along said course and substantially flat on said surface in order to allow the runner's feet to flatly engage said surface along said course when the cross member is stepped on, means connected to said framework and providing a grid at a predetermined height above said surface and at predetermined spaced intervals to define spaces along said course in which the runner is to place his feet during use, and resilient means on said grid means having sufficient resiliency to yield sufficiently to permit the runner's foot to engage said surface along said course when stepped on.

9. The runway of claim 8 wherein said cross member is formed of flat spring metal, said cross member being flexible and including a central section and two upstanding legs to support said side members, said center section having an upward bow and said upstanding legs angling outwardly from the runway, said resilient means including said upstanding legs and elastic ropes forming said grid means having sufficient tension to eliminate the bow in the center section and position said leg upright when attached to said side members.

10. The runway of claim 9 wherein said side members are substantially rigid to provide the spacing between said cross members.

* * * * *